United States Patent [19]

Courtis et al.

[11] 4,270,312

[45] Jun. 2, 1981

[54] GATE ASSEMBLY

[75] Inventors: Thomas M. Courtis; Carl E. Donelson, both of Red Lodge, Mont.

[73] Assignee: Red Lodge Manufacturing Company, Red Lodge, Mont.

[21] Appl. No.: 82,543

[22] Filed: Oct. 9, 1979

[51] Int. Cl.[3] ..... E05D 7/00

[52] U.S. Cl. ..... 49/385; 49/386; 49/139; 16/85

[58] Field of Search ..... 49/385, 386, 301, 331, 49/347, 139; 16/72, 85

[56] References Cited

U.S. PATENT DOCUMENTS

| | | | |
|---|---|---|---|
| 800,078 | 9/1905 | Connolly | 49/386 X |
| 1,611,367 | 12/1926 | Pickett | 49/383 X |
| 1,721,308 | 7/1929 | Lormor | 49/386 X |
| 2,839,852 | 6/1958 | Schloer | 49/386 X |
| 3,040,457 | 6/1962 | Rothross | 49/386 X |
| 3,839,826 | 10/1974 | Ries | 49/385 X |

*Primary Examiner*—Kenneth Downey
*Attorney, Agent, or Firm*—Arthur L. Urban

[57] ABSTRACT

A gate assembly including a support structure, a gate carried by the support structure and movable with respect thereto, and a gate control associated with the gate, the support structure including a plurality of frame members, the gate having one end thereof disposed adjacent to the support structure and extending outwardly therefrom, a pivot connecting a lower part of the gate to an adjacent lower portion of the support structure, a pivot including a rotatable shaft and shaft carrier, the gate control including at least one coil spring member, one end of the spring member being attached to an upper part of the gate adjacent to the support structure and the opposite end of the spring member being affixed to the support structure at a point spaced from the pivot, a fulcrum disposed adjacent the end of the spring member affixed to the support structure, the fulcrum being disposed on the side of the spring member remote from the pivot, the fulcrum including an arcuate spring-engaging section disposed in substantially the same vertical place as the spring member, whereby the gate is movable about the pivot in a vertical plane with the movement thereof being controllable by the spring member throughout its path as the spring member moves into contact with the spring-engaging section of the fulcrum.

16 Claims, 4 Drawing Figures

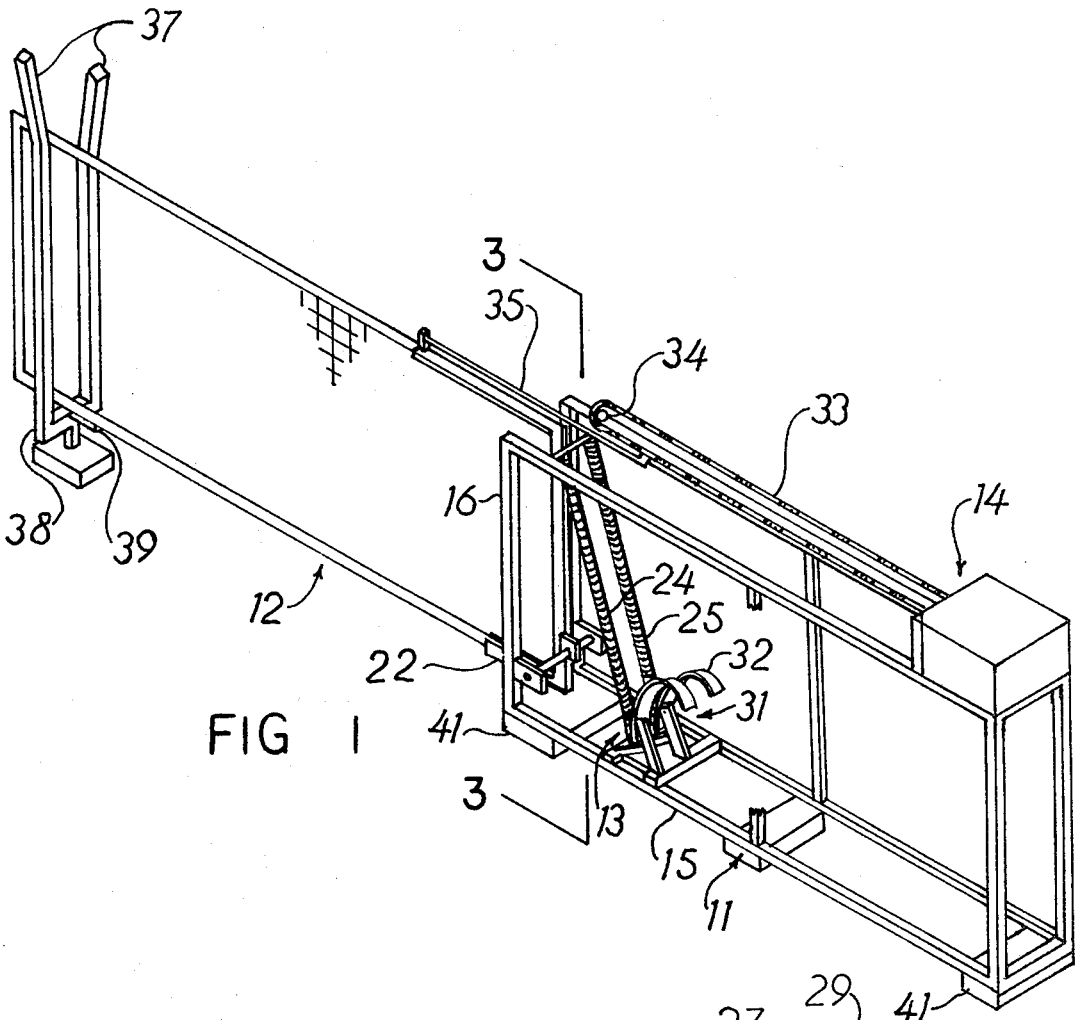
FIG 1
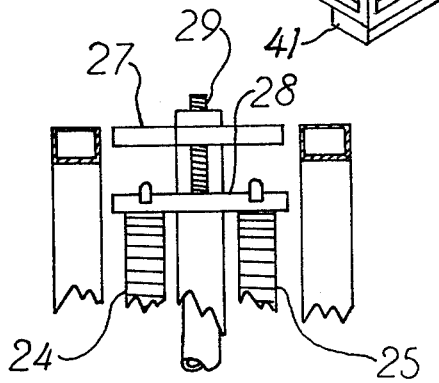
FIG 3
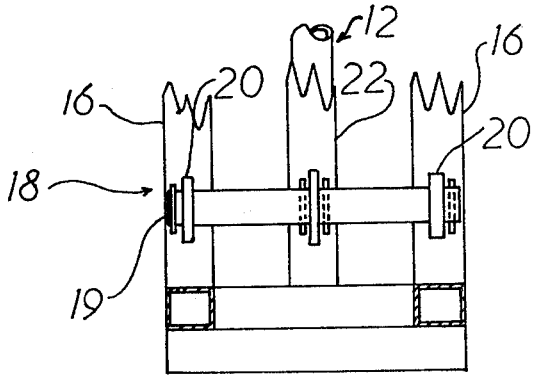

GATE ASSEMBLY

This invention relates to a novel gate assembly and more particularly relates to a new gate assembly which can be operated automatically.

For many centuries, individuals have enclosed their land to protect their home and other property. This has been done both in urban and rural areas. In some cases, the enclosures have been simple fences to keep children or animals confined, while in other situations, the fencing serves to protect the property against human or animal intruders.

Regardless of the type of enclosure or fencing utilized, some type of opening must be provided for ingress and egress to and from the property. Generally, the opening has a gate.

Gates commonly are used for walkways and roadways. The most common gate style is the swinging gate. While swinging gates are satisfactory for walkways, their use becomes more cumbersome as they increase in size, such as for roadways.

Conventional roadway gates have a number of drawbacks. For example, the weight of roadway gates presents a problem in the selection of the hinges. Also, the weight may make the gate difficult to operate. In an attempt to solve these problems, pairs of gates meeting at the center sometimes are utilized.

Another problem with roadway gates is the necessity for getting out of the vehicle to open the gate, driving the vehicle through and getting out of the vehicle again to close the gate. This is troublesome even under ideal weather conditions, but in inclement weather and at night it is especially unpleasant.

It has been proposed to utilize power operated roadway gates. However, mechanisms to operate swinging gates are complicated and expensive. As a result, other proposals for power operated roadway gates have been made. Some gates have an overhead framework into which the gates are raised. Such gates of necessity have limited overhead clearance and are unsightly in appearance because of the overhead structural elements.

One power operated gate of a different design pivots the gate so that it stands on end when opened. This type of gate is the subject of U.S. Pat. No. 3,839,826. The gate utilizes a combination of a tension spring and a torsion spring. The tension spring urges the gate from the closed position toward the open position while the torsion spring acts in the opposite direction.

While this vertically swinging gate construction offers advantages over swinging gates, particularly in snowy climates, it has certain shortcomings. The motor has to be of considerable size because of its location adjacent the pivot point of the gate. Also, the use of the combination of the torsion spring and the tension spring makes the design somewhat complicated and increases the cost thereof.

The present invention provides a novel gate assembly which is simple in design and relatively inexpensive to manufacture. The gate assembly can be fabricated from commercially available components and materials. The gate assembly of the invention can utilize prefabricated gates or those which are custom fabricated to provide a particular functional or decorative effect.

The gate assembly of the invention can be operated simply and conveniently both manually or with a power source. The gate assembly can be powered by a conventional garage door opening unit. The gate assembly can be operated manually using only a minimum of effort. Thus, the gate assembly of the invention can be opened easily in the event of a power stoppage.

The gate assembly can be installed by a homeowner or ranch hand with a minimum of instruction. The gate assembly of the invention can be adapted to provide a positive lock if desired. In addition, the gate assembly of the invention provides for adjustment of the operating mechanism as components thereof age and/or wear.

Other benefits and advantages of the novel gate assembly of the present invention will be apparent from the following description and the accompanying drawings in which:

FIG. 1 is a view in perspective of one form of the gate assembly of the invention in a closed position;

FIG. 3 is an enlarged fragmentary sectional view taken along line 3—3 of FIG. 1.

Figure 2:
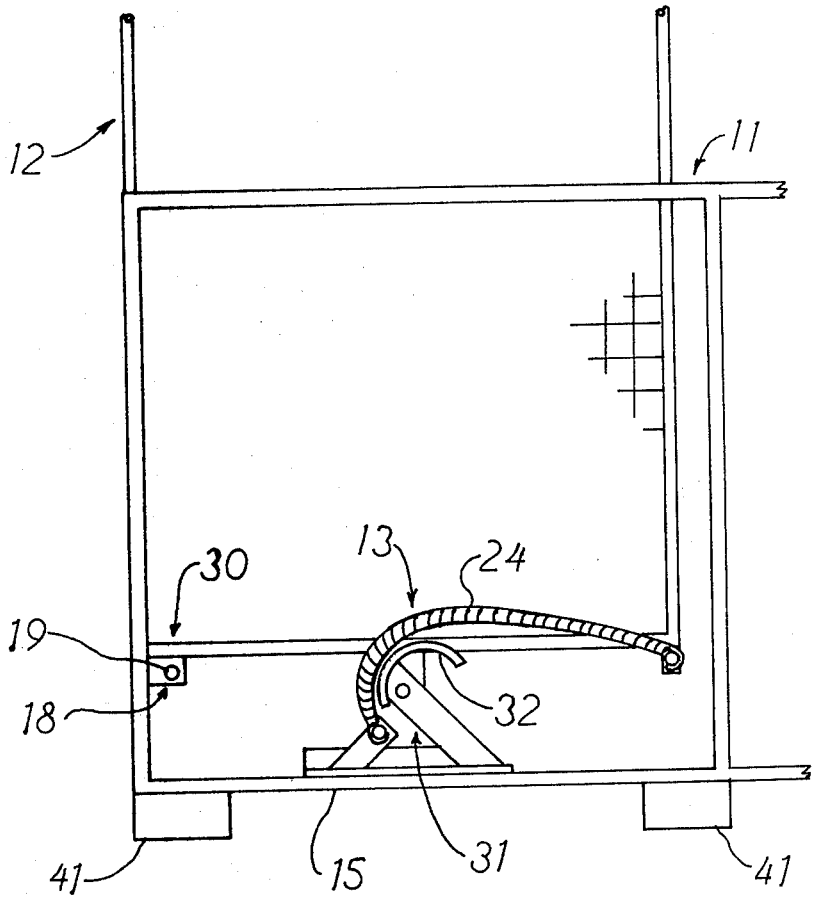
FIG. 2 is a side view of the gate assembly shown in FIG. 1 in an open position.

As shown in the drawings, one form of the novel gate assembly of the invention includes support means 11 and gate means 12 carried by the support means. The gate portion 12 is movable with respect to the support means 11. Gate control means 13 and advantageously gate activating means 14 are included in the gate assembly. The gate control means 13 and the gate activating means 14 preferably are mounted on frame members of the support portion 11 shown as generally horizontal members 15 and generally vertical members 16. Advantageously, the support 11 includes pairs of generally vertical and horizontal frame members 15 and 16 disposed on either side of the gate.

Gate 12 which is movable with respect to the support 11 has one end thereof disposed adjacent thereto with the gate 12 extending outwardly therefrom. The lower part of the gate end adjacent to the support frame is connected thereto through pivot means 18.

Figure 4:
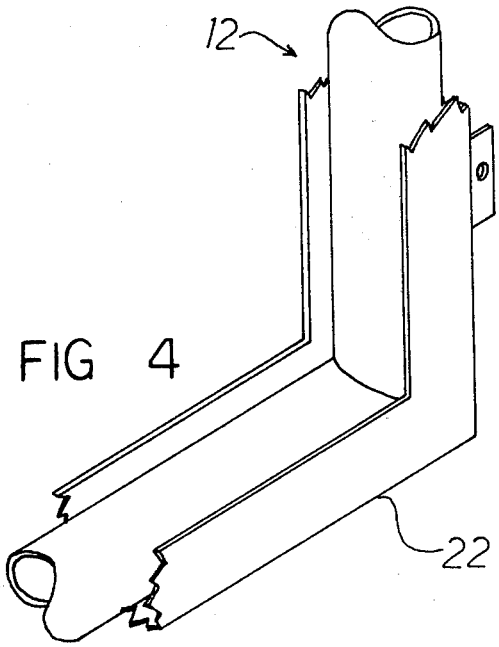
FIG. 4 is an enlarged view in perspective of the gate engaging portion of the gate assembly shown in FIG. 1.

The pivot means 18 connecting the gate 12 with the support frame 11 includes a rotatable shaft 19 and shaft support means. As shown in FIG. 2, shaft 19 is carried by shaft supporting brackets 20 affixed to vertical frame members 16. Pivot means 18 advantageously may include a gate support member 22 that can be affixed or carried by the central portion of shaft 19. Preferably, as shown in FIG. 4, the gate support member 22 includes a gate engaging channel section which is secured to the end of the gate 12 adjacent support frame 11. In this case, the shaft 19 may be located on the side of frame member 16 adjacent to the spring members.

The gate control means 13 includes at least one coil spring member 24, and preferably a pair of coil spring members 24 and 25. The spring members 24 and 25 are spaced from each other a sufficient distance that the gate 12 may pass therebetween in its movement from a closed to an open position. The upper end of each spring member is attached adjacent the upper corner of the gate closest thereto, that is, closest to the vertical frame members 16. The opposite or lower end of each spring member is affixed to a horizontal frame member 15 of support 11 at a point therealong spaced from the pivot means 18. Advantageously, the lower ends of the spring members are secured to the horizontal frame member 15 a distance from the shaft 19 of the pivot means 18 between about 25% and 40% of the length of the spring member.

The gate assembly advantageously also includes spring adjusting means. Preferably, the spring adjusting means changes the length and thereby the tension in the spring members 24 and 25. The upper ends of the spring members 24 and 25 advantageously are connected to the adjacent upper corner of the gate 12 through the spring adjusting means, which preferably may include a fixed portion 27 and a movable portion 28. As shown in FIG. 3, section 27 is affixed adjacent the corner of the gate 12 and movable section 28 engages the upper ends of the spring members 24 and 25. A screw 29 is operatively connected to the movable spring holding section 28 to provide adjustment thereof.

Fulcrum means 31 are disposed adjacent the lower end of the spring members 24 and 25. The fulcrum means 31 is affixed to the horizontal frame member 15 on the side of the spring members remote from the pivot means 18. The fulcrum 31 includes an arcuate spring-engaging section 32 disposed in substantially the same vertical plane as the coil spring members. Advantageously, the spring engaging section 32 of the fulcrum describes an arc of between about 120° and 180°. The spring-engaging section 32 preferably is spaced from the lower ends of the spring members a distance between about 10% and 30% of the length of the spring members. The fulcrum 31 may serve for both of the spring members 24 and 25 or more advantageously as shown, a separate fulcrum may be utilized adjacent each spring member. With this arrangement, the spacing of the fulcrums provides clearance for the passage of the gate 12 therebetween.

If desired, gate activating means 14 may be provided to effect movement of the gate from the down position or closed position and return. The gate activating means advantageously is mounted on the upper part of the support 11 of the assembly. The gate activating means includes an electric motor which is operatively connected to the gate 12. The gate activating means preferably is connected to the gate through a combination of a chain 33 and sprockets 34. A connecting rod 35 may be utilized to connect the gate and the chain. A suitable gate activating means may be a conventional garage door opening unit.

The gate assembly of the invention also advantageously includes gate restraining means when the gate is in a closed position. As shown in the drawings, the gate restraining means may include spaced vertical members 37 which extend upwardly from a common support 38. The spaced vertical members 37 are disposed on either side of the gate 12 at the free end thereof when the gate is in a down position. Preferably, the gate restraining means includes locking means 39 which secures the gate to the restraining means. The locking means 39 preferably may be actuatable simultaneously with or slightly ahead of the gate activating means by appropriate circuitry (not shown).

The gate assembly of the invention shown in the drawings may be assembled by positioning the support 11 on a suitable foundation such as blocks 41 and secured thereto. Thereafter, gate 12 may be affixed to the gate support member 22 and the gate support member connected to shaft 19. Shaft 19 is carried between brackets 20 mounted on vertical frame members 16. The spring adjusting means is located adjacent the upper corner of the gate. The spring adjusting means has section 27 affixed adjacent the upper gate corner with section 28 movably connected thereto.

One end of each of spring members 24 and 25 is connected to the movable section 28 of the spring adjusting means and the lower ends thereof are connected to the frame member 15 as shown in FIG. 3. The tension in the spring members is adjusted by rotating screw 29 which is operatively connected to the movable spring holding section 28.

In the operation and use of the gate assembly of the present invention as shown in the drawings, the gate activating mechanism may be actuated such as with a radio transmitter (not shown) of a garage door operator 14. This starts the operation of the electric motor and the movement of the chain 33 and sprockets 34 connected thereto. The movement of the chain draws the upper corner of the gate 12 into the support frame 11 and rotates the end of the gate about the pivot means including shaft 19. As the upper corner of the gate continues in its path of movement within the support frame 11, the top corner of the gate and the end of the spring members affixed thereto will move past the fulcrum 31 and causing the spring members to wrap around the spring engaging sections 32 of the fulcrums.

To close the gate assembly, the radio transmitter may be actuated again to reverse the movement of the motor and the direction of travel of the chain 33. This action will move the top corner of the gate 12 from a position adjacent the horizontal members 15 past the fulcrum 31 again to its original position at the upper part of the vertical frame members 16. Simultaneously, with the travel of the gate 12, the upper part of the spring members attached at the upper corner of the gate will move away from the spring-engaging fulcrum section 32 so that the spring members will return from the bent configuration when the gate is open to the straight configuration again.

Operation of the gate assembly of the invention also can be effected through the use of electrical switches located adjacent the assembly or manually, if desired. Manual operation may be achieved conveniently by opening lock 39 and simply lifting the free end of the gate 12. Since the spring members 24 and 25 in combination with the fulcrums 31 provide an effective counterbalancing of the movement of the gate, the gate can be lifted with a minimum of effort. Also, since the spring members 24 and 25 function effectively over the entire path of movement of the gate from an open to a closed position and vice-versa, positive control of the gate movement is achieved during the entire operation.

The above description and accompanying drawings show that the present invention provides a novel gate assembly which is simple in design and convenient to use. The gate assembly of the invention can be fabricated from commercially available components and materials relatively inexpensively. The gate assembly of the invention can utilize commercially available gates or custom fabricated gates.

The gate assembly of the invention can be operated manually or with a power source and even by a conventional garage door opening unit. The gate assembly can be operated manually with a minimum of effort. Also, the gate assembly can be operated through a radio transmitter or suitable switches.

The gate assembly of the present invention can be installed by a homeowner or a ranch hand with a minimum of instruction. In addition, the gate assembly provides for the adjustment of the control mechanism as components thereof age and/or wear.

It will be apparent that various modifications can be made in the particular gate assembly described in detail above and shown in the drawings within the scope of the invention. For example, the size and configuration of the components can be changed to meet specific requirements. Also, a variety of structural materials may be utilized in the fabrication of the gate assembly as desired. Therefore, the scope of the invention is to be limited only by the following claims:

What is claimed is:

1. A gate assembly including support means, gate means carried by said support means and movable with respect thereto, and gate control means associated with said gate means; said support means including a plurality of frame members, said gate means having one end thereof disposed adjacent to said support means and extending outwardly therefrom, pivot means connecting a lower part of said gate means to an adjacent lower portion of said support means, said pivot means including a rotatable shaft and shaft carrier means, said gate control means including at least one coil spring member, one end of said spring member being attached to an upper part of said gate means adjacent to said support means and the opposite end of said spring member being affixed to said support means at a point spaced from said pivot means, fulcrum means disposed adjacent the end of said spring member affixed to said support means, said fulcrum means being disposed on the side of said spring member remote from said pivot means, said fulcrum means including an arcuate spring-engaging section disposed in substantially the same vertical plane as said spring member, whereby said gate means is movable about said pivot means in a vertical plane with the movement thereof being controllable by said spring member throughout its path as said spring member moves into contact with said spring-engaging section of said fulcrum means.

2. A gate assembly according to claim 1 wherein said support means includes pairs of generally vertical and horizontal frame members disposed on either side of said adjacent gate end.

3. A gate assembly according to claim 2 including pairs of coil spring members with fulcrum means adjacent each spring member.

4. A gate assembly according to claim 1 including gate restraining means disposed adjacent the free end of said gate means.

5. A gate assembly according to claim 1 wherein said shaft of said pivot means is disposed on the side of said vertical frame member adjacent said spring member.

6. A gate assembly according to claim 2 wherein said pivot means is supported between said pair of generally vertical frame members.

7. A gate assembly according to claim 2 wherein the lower end of said spring member is affixed to said horizontal frame member a distance from said pivot means between about 25% and 40% of the length of said spring member.

8. A gate assembly according to claim 1 wherein said spring-engaging section of said fulcrum means is spaced from the lower end of said spring member a distance between about 10% and 30% of the length of said spring member.

9. A gate assembly according to claim 1 wherein said spring-engaging section of said fulcrum means describes an arc of between about 120° and 180°.

10. A gate assembly according to claim 1 including gate activating means.

11. A gate assembly according to claim 10 wherein said gate activating means includes an electric motor and a chain and sprocket arrangement connected to the upper portion of said gate means.

12. A gate assembly according to claim 10 wherein said gate activating means is mounted on the upper portion of said support frame means.

13. A gate assembly according to claim 1 including spring adjusting means.

14. A gate assembly according to claim 13 wherein said spring adjusting means operatively connects said spring member with said gate means.

15. A gate assembly according to claim 14 wherein said spring adjusting means includes a fixed section and a section movable with respect thereto.

16. A gate assembly according to claim 1 wherein said pivot means includes a gate engaging channel section.

* * * * *